US006418289B1

(12) United States Patent
Kleckner et al.

(10) Patent No.: US 6,418,289 B1
(45) Date of Patent: Jul. 9, 2002

(54) DRYING DEVICE AND METHOD FOR DRYING INK ON A MEDIUM

(75) Inventors: Robert Kleckner, Pittsford; Gerald A. Domoto, Briarcliff Manor; F. James Wang, Pittsford, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/725,282

(22) Filed: Nov. 29, 2000

(51) Int. Cl.[7] ..... G03G 15/10

(52) U.S. Cl. ..... 399/251; 34/653

(58) Field of Search ..... 399/249, 251; 34/122, 653, 654

(56) References Cited

U.S. PATENT DOCUMENTS 3,659,348 A * 5/1972 Frank ..... 34/122
3,805,409 A * 4/1974 Sato et al. ..... 34/653
5,812,913 A * 9/1998 Morris et al. ..... 399/251

FOREIGN PATENT DOCUMENTS

JP 11-59010 * 3/1999

* cited by examiner

*Primary Examiner*—Joan Pendegrass
(74) *Attorney, Agent, or Firm*—Oliff & Berridge, PLC

(57) ABSTRACT

An apparatus is provided for drying a liquid image carried on a surface of a medium moving along a predetermined path from an upstream location towards a downstream location. The apparatus includes an air moving device, such as a blower, that moves air. A plenum has an intake that receives air and an outlet permitting the air to exit the plenum. A channel structure communicates with the outlet of the plenum and is disposed generally adjacent to a surface of the medium carrying the image. The channel structure includes an upstream channel portion and a downstream channel portion such that air exiting the outlet of the plenum is diverted to flow towards the upstream location in the upstream channel portion and towards the downstream location in the downstream channel portion. A heater is associated with the medium to heat at least a portion of the medium and thus the image. A method of drying a liquid image on a surface of a medium is also provided. The apparatus and method may arranged so that the direction of air is reversed where the air then moves along the channel structure by suction action rather than by being blown through the channel.

17 Claims, 2 Drawing Sheets

DRYING DEVICE AND METHOD FOR DRYING INK ON A MEDIUM

FIELD OF THE INVENTION

This invention relates to drying ink on a medium and, more particularly, to drying an image created by a liquid ink printer by passing air over the image while heating the image by conduction.

BACKGROUND OF THE INVENTION

A key requirement of liquid ink printers, particularly color printers, is that the previous image must be dried before a subsequent image can be written thereon. Drying can be achieved by using radiant energy to dry the fluid. However, this method is not preferred because of the long distance required for providing a heater in the process direction (requiring a long machine with a large footprint), and the possibility of fire or explosion due to the evaporating carrier fluid, if the carrier fluid or medium is flammable. Further, the heated image-bearing medium may change its shape as the temperature thereof increases. This severely complicates, or makes impossible, the registration of the color separations.

Another drying method includes blowing room temperature air across the wet surface to vaporize the fluid. Due to the simplicity of this approach, this method is preferred in printers that operate at very low process speeds. However, very high flow rates or very high volumes of air will be required to dry images in high productivity applications, which makes this method impractical. Further, this method may result in an image that is not uniformly dried across the process direction, leaving wet areas at the edges of the image.

With reference to FIG. 1, a schematic illustration of a conventional single pass color printer, generally indicated at 10, is shown where a color image is created by superimposing color separations. The image processing involves passing the medium 12 over the writing head 14 to form a latent image for the first color 16. The medium 12 then passes over a development station 18 and a wet, visible image is created. The wet image is then moved past a drying station 20 which removes excess carrier fluid from the liquid image thereby preparing the image to receive the latent image for the next color 22. An example of this printer architecture is disclosed, for example, in U.S. Pat. No. 5,420,673. In such printers, room temperature air is blown across the wet image though a specifically designed channel to make more efficient use of the air. These dryers, although more effective than the dryers discussed above, are inadequate at high process speeds. The efficiency of these dryers is acceptable at high speeds only when the drying length is increased. Increasing the drying length results in a longer machine and larger footprint. Further, sealing the air against a wide web is difficult and, as a consequence, this type of dryer becomes less efficient as air leaks past the medium.

Accordingly, there is a need to provide a liquid ink drying device for uniformly drying an image in the cross-process direction, which occupies a minimum amount of space in the process direction, and dries the image without affecting the registration of the color separations.

SUMMARY OF THE INVENTION

An object of the present invention is to at least fulfill the needs referred to above. In accordance with the principles of the present invention, these and other objectives are attained by providing an apparatus for drying a liquid image carried on a surface of a medium moving though a predetermined path from an upstream location towards a downstream location. The apparatus includes a device for moving air, such as a fan or blower. A plenum has an intake for receiving the air and an outlet permitting the air to exit the plenum. A channel structure communicates with the outlet of the plenum and is disposed generally adjacent to a surface of the medium carrying the image. The channel structure includes an upstream channel portion and a downstream channel portion such that air exiting the outlet of the plenum is diverted to flow towards the upstream location in the upstream channel portion and towards the downstream location in the downstream channel portion. A heater is associated with the medium to heat at least a portion of the medium and thus the image.

In accordance with another aspect of the invention, a method of drying a liquid image on a surface of a medium moving though a predetermined path provides a source of air moving in a first direction. The source of air is directed to move past the image (1) in a second direction transverse to the first direction, and (2) in a third direction opposite the second direction, to dry the image as the image moves through the predetermined path.

Other objects, features and characteristics of the present invention, as well as the methods of operation and the functions of the related elements of the structure, the combination of parts and economics of manufacture will become more apparent upon consideration of the following illustrative embodiments and appended claims with reference to the accompanying drawings, all of which form a part of this specification.

BRIEF DESCRIPTION OF THE DRAWINGS

Reference is made to the attached drawings, wherein elements having the same reference numeral designations represent like elements throughout and wherein.

DESCRIPTION OF ILLUSTRATIVE EMBODIMENTS

Figure 1:
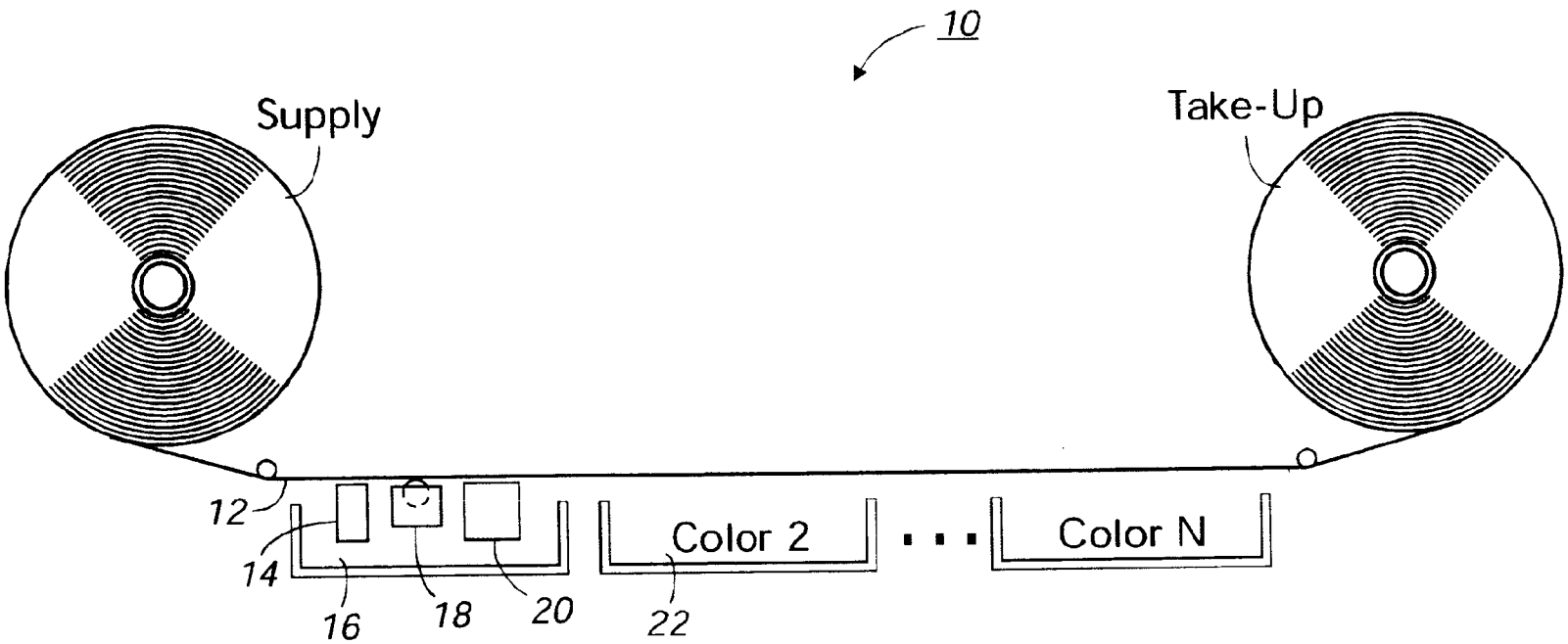
FIG. 1 PRIOR ART
FIG. 1 is a schematic illustration of a conventional single pass color printer having drying structure.
Figure 2:
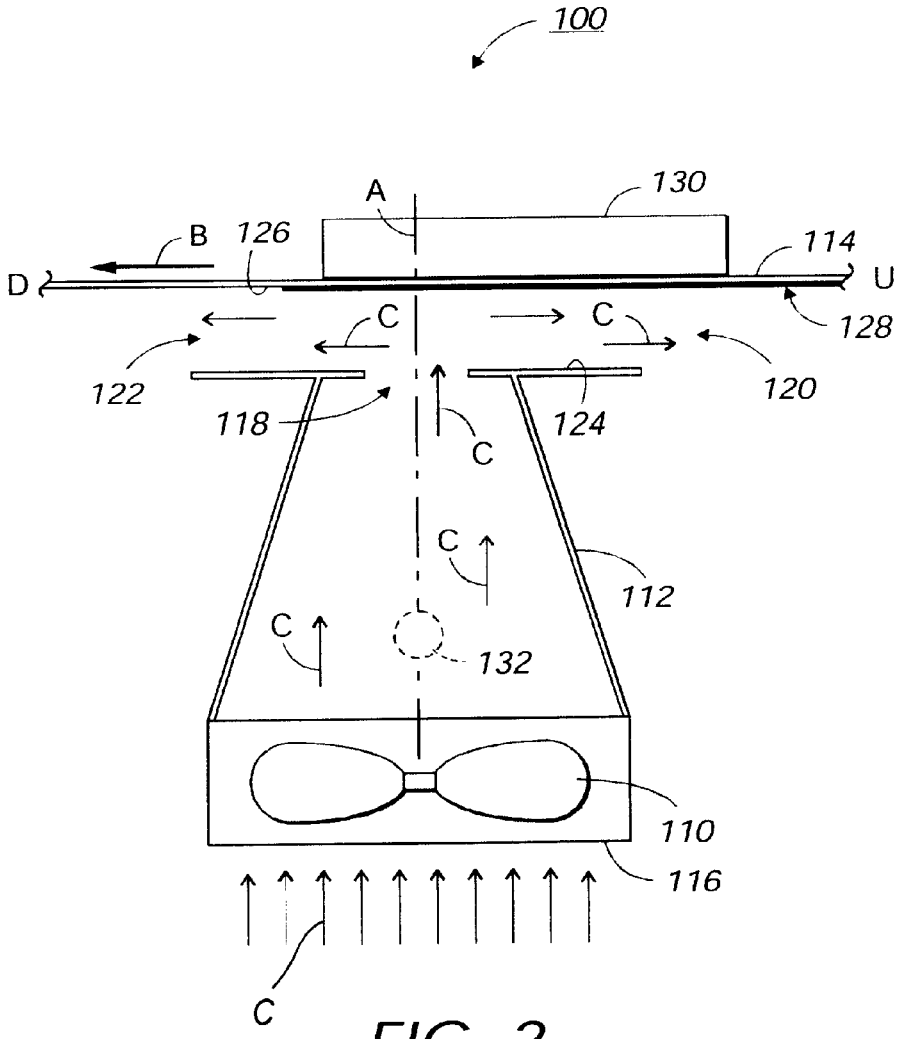
FIG. 2 is a schematic illustration of a drying device for drying liquid on a medium, provided in accordance with the principles of the present invention.

Referring to FIG. 2, a schematic illustration of a drying device, generally indicated at 100, is shown provided in accordance with a first embodiment of the present invention.

The device 100 includes blower structure 110 comprising one or more blowers or fans to draw or push air. A plenum 112 guides the air moved by the blower structure 110 to a recording medium 114 such as paper. The medium 114 is moved in the conventional manner along a predetermined path in the direction indicated by arrow B. The plenum 112 has an air intake 116 at one end thereof to receive air moved by the blower structure 110, and an outlet 118 to deliver the air to the medium 114. The size of the outlet 118 is selected to assure that the airflow is uniform in the cross-process direction as indicated by the direction of central axis A. In the illustrated embodiment, the plenum 112 preferably has a rectangular cross-section and defines a volume, and the outlet 118 is centrally located about the central axis A of the plenum. Channel structure is in communication with outlet 118 and is disposed generally adjacent to the medium 114. The channel structure includes an upstream channel portion 120 and a downstream channel portion 122. The channel portions 120 and 122 are formed by a rear surface 124 of the plenum 112 and a surface 126 of the medium 114. The channel structure and the surfaces defining the outlet 118 are constructed and arranged to divert the air moving in a first direction (e.g. direction of axis A) to second direction or upstream airflow, and to a third direction or downstream airflow. Thus, both the second and third directions are transverse with respect to the first direction and the third airflow direction is opposite the second direction.

As shown in FIG. 2, the medium 114 moves in the direction of arrow B from an upstream location U (right portion of FIG. 2) to a downstream location D (left portion of FIG. 2). The wet image 128 on medium 114 enters the drying zone from the upstream location U and is heated by the backside heater 130. This heating increases the vapor pressure of the fluid and enhances drying. The image 128 is dried by the flow of air delivered from the plenum 112 to the upstream and downstream channel portions 120 and 122, respectively, as the image 128 moves from upstream to downstream in the direction of arrow B. Airflow direction is shown by the arrows C in FIG. 2.

In the illustrated embodiment, the backside heater 130 is placed off-center with respect to axis A so that a substantial portion of the heater 130 is disposed upstream of the central axis A. With this arrangement, the image 128 is cooled by the drying air as the image 128 exits the device 100. Misregistration at the subsequent writing station, due to thermal expansion of the medium, is thus minimized.

As shown in FIG. 2, an optional air heater 132 can be employed in, or in communication with, the plenum 112 to heat the air to further promote drying of the image 128.

By employing the upstream and downstream channel portions 120 and 122, respectively, the resistance to flow is reduced by half as compared to the conventional drying devices. This advantageously enables the flow rate of the drying air to be doubled for a given design volume in the process direction (direction of arrow B in FIG. 2). Thus, the device 100 makes optimum use of the process direction space. Furthermore, the heater 130 and dual channel portions 120 and 122 enable drying of images 128 at high process speed.

Heating the image 128 by conduction, via the backside heater 130, is significantly more efficient that heating the image with hot air. The heater 130 is incorporated into a skid plate or in other devices such as a heater roller.

It can be appreciated that the device 100 is operational with positive or negative pressure (suction). In a "suction" mode, the operation of the air moving device, e.g., blower 110, is reversed so that air is removed from plenum 112. In this case, the direction of air indicated by arrows C are reversed in the plenum 112 as well as in the channels 120 and 122. Advantageously, such suction action enables the collection of vaporized ink from the medium through a discharge path of the plenum rather than being dissipated or vented through channels 120 and 122.

The device 100 can be used to dry liquid inks on recording medium such as paper, treated paper, polymers, electroreceptors, photoreceptors, etc. The device 100 is particularly useful in color imaging architectures, for example, a 2.5 ips liquid medium printing machine.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An apparatus for drying a liquid image carried on a medium moving along a predetermined path from an upstream location towards a downstream location, the apparatus comprising:

a device that moves air;

a plenum having an intake that receives the air and an outlet permitting the air to exit the plenum, wherein the outlet is disposed about a central axis of the plenum;

a channel communicating with the outlet of the plenum and disposed generally adjacent to a surface of the medium carrying the image, the channel including an upstream channel portion and a downstream channel portion such that air exiting the outlet of the plenum is diverted to flow towards the upstream location in the upstream channel portion and towards the downstream location in the downstream channel portion; and a heater associated with the medium to heat at least a portion of the medium and thus the image, wherein a substantial portion of the heater is located upstream of the central axis.

2. The apparatus of claim 1, wherein the outlet and the channel structure are constructed and arranged to divert air flow moving in a direction that is generally perpendicular to upstream airflow and downstream airflow along said predetermined path.

3. The apparatus of claim 1, wherein the upstream and downstream channel portions are defined by surfaces of the plenum and a surface of the medium.

4. The apparatus of claim 1, further comprising an air heater to heat the air in the plenum.

5. The apparatus of claim 1, wherein the device comprises a blower that moves air from the intake to the outlet.

6. The apparatus of claim 1, wherein the outlet receives the air and the intake permits the air to exit the plenum.

7. An apparatus for drying a liquid image carried on a medium moving along a predetermined path from an upstream location towards a downstream location, the apparatus comprising:

a device that moves air;

a plenum having an intake that receives the air and an outlet permitting the air to exit the plenum;

a channel communicating with the outlet of the plenum and disposed generally adjacent to a surface of the medium carrying the image, the channel including an upstream channel portion and a downstream channel portion such that air exiting the outlet of the plenum is diverted to flow towards the upstream location in the upstream channel portion and towards the downstream location in the downstream channel portion; and a heater associated with the medium to heat at least a portion of the medium and thus the image, wherein the heater is constructed and arranged to heat a back side of the medium by conduction, thus heating the image.

8. The apparatus of claim 7, wherein the outlet and the channel structure are constructed and arranged to divert air flow moving in a direction that is generally perpendicular to upstream airflow and downstream airflow along said predetermined path.

9. The apparatus of claim 7, wherein the upstream and downstream channel portions are defined by surfaces of the plenum and a surface of the medium.

10. The apparatus of claim 7, further comprising an air heater to heat the air in the plenum.

11. The apparatus of claim 7, wherein the device comprises a blower that moves air from the intake to the outlet.

12. The apparatus of claim 7, wherein the outlet receives the air and the intake permits the air to exit the plenum.

13. An apparatus that dries a liquid image of a medium moving along a predetermined path from an upstream location towards a downstream location, the apparatus comprising:

an air moving structure that moves air;

a plenum having a first opening that receives the air moved by the air moving structure and a second opening permitting the air to exit the plenum;

a channel structure communicating with one of the first and second openings of the plenum and disposed generally adjacent to a surface of the medium carrying the image, the channel structure including an upstream channel portion and a downstream channel portion such that the air flows towards the upstream location, towards the downstream location, and through the plenum; and a heater associated with the medium to heat at least a portion of the medium and thus the image, wherein a substantial portion of the heater is located upstream of a central axis of the plenum.

14. The apparatus of claim 13, wherein the first opening is an intake, the second opening is an outlet and the air moving structure is constructed and arranged to push the air through the outlet of the plenum and through the upstream channel portion and the downstream channel portion.

15. The apparatus of claim 14, wherein the outlet is disposed about a central axis of the plenum.

16. A method of drying a liquid image of a medium moving along a predetermined path, the method comprising:

directing air past the image in an upstream direction relative to the movement of the medium and in an opposite, downstream direction;

drying the image as the image moves along the predetermined path;

heating the medium by conduction using a heater that extends towards the upstream direction and associated with the mediums thus heat the image as the image passes the heater; and cooling the image using the air moving in the downstream direction.

17. A method of drying a liquid image of a medium moving along a predetermined path, the method including:

moving air in a first direction perpendicular to the predetermined path; and directing the air to move past the image (1) in a second direction transverse to the first direction, and (2) in a third direction opposite the second direction, to dry the image as the image moves through the predetermined path, wherein the second direction is an upstream direction relative to the movement of the medium;

heating the medium by conduction using a heater that extends towards the upstream direction and associated with the medium and thus heat the image as the image passes the heater; and cooling the image using the air moving in the third direction.

* * * * *